US005423177A

United States Patent [19]

Raasch

[11] Patent Number: 5,423,177

[45] Date of Patent: Jun. 13, 1995

[54] APPARATUS FOR OPEN-END SPINNING

[75] Inventor: Hans Raasch, Mönchengladbach, Germany

[73] Assignee: W. Schlafhorst AG & Co., Moenchengladbach, Germany

[21] Appl. No.: 97,127

[22] Filed: Jul. 26, 1993

[30] Foreign Application Priority Data

Jul. 25, 1992 [DE] Germany ..... 42 24 632.6

[51] Int. Cl.[6] ..... D01H 4/40

[52] U.S. Cl. ..... 57/417

[58] Field of Search ..... 57/417

[56] References Cited

U.S. PATENT DOCUMENTS

| | | | |
|---|---|---|---|
| 3,875,731 | 4/1975 | Khomyakov et al. | 57/417 |
| 4,665,687 | 5/1987 | Ott et al. | 57/417 |
| 4,702,069 | 10/1987 | Maximov et al. | 57/417 |

FOREIGN PATENT DOCUMENTS

| | | | |
|---|---|---|---|
| 3707526 | 9/1988 | Germany . | |
| 4039755 | 6/1992 | Germany | 57/417 |
| 503127 | 3/1971 | Switzerland . | |

*Primary Examiner*—Joseph J. Hail, III

*Attorney, Agent, or Firm*—Herbert L. Lerner; Laurence A. Greenberg

[57] ABSTRACT

A yarn draw-off nozzle for an open-end spinning station of a rotor spinning machine includes a yarn feed region including a spiral having at least one turn with spirally extending surfaces disposed one above the other being rectilinear with respect to a yarn travel direction. The surfaces are each inclined at an angle relative to the surfaces located above and below them, defining spirally extending yarn deflection locations for supporting yarn to be drawn off.

4 Claims, 3 Drawing Sheets

APPARATUS FOR OPEN-END SPINNING

BACKGROUND OF THE INVENTION

1. Field of the Invention

The invention relates to a yarn draw-off nozzle for an open-end spinning station of a rotor spinning machine, with spirally extending yarn deflection points or locations being disposed in a yarn feed region for supporting yarn to be drawn off.

In open-end rotor spinning, in which a spinning rotor is used as a twister, a problem which occurs is that the actual yarn twist does not uniformly run into the existing end of the yarn. In open-end rotor spinning, the actual yarn twist is imparted substantially to the piece of the yarn between the yarn draw-off nozzle and the yarn draw-off device. The yarn twist only incompletely runs into or enters the piece of yarn ahead of the draw-off nozzle, that is the piece of yarn that extends from the yarn draw-off nozzle to the rotor groove. That piece of yarn often has less twist than the normal yarn, so that the spinning stability suffers as a result.

In the industry, yarn draw-off nozzles that are provided with a surface structure such that the friction of the yarn on the yarn draw-off nozzle produces a false twist are therefore often used. In that way, the twist in the segment of yarn between the yarn draw-off nozzle and the rotor groove is increased.

Swiss Patent No. 503 127, for instance, discloses a yarn draw-off nozzle with a spiral structure in the yarn feed region. That spiral is constructed in the form of either a groove or a rib.

With yarn draw-off nozzles constructed in that way, the yarn rests on riblike protrusions that extend spirally from a bore in the draw-off nozzle to the rim of its mouth. The direction of the spiral extends in such a way that depending on the rotational direction of the yarn, a shear component is exerted on the yarn, acting in the direction of the rotor groove. The effect of the shear component is that the yarn twist between the yarn draw-off nozzle and the rotor groove is hindered from leaving that region. With spiral draw-off nozzles constructed in that way, in contrast to draw-off nozzles with a smooth or notched surface, greater twist is imparted to the sliver in the rotor groove, and therefore the number of breaks that occur in the yarn is lowered. Such spiral draw-off nozzles also offer the opportunity of reversing the yarn twist by increasing the yarn draw-off speed, without changing the original yarn breakage numbers, which leads to an increase in production speed.

However, a disadvantage of those known spiral yarn draw-off nozzles is that because of the ribs there is relatively great stress on the yarn, which is not acceptable for all types of yarn.

SUMMARY OF THE INVENTION

It is accordingly an object of the invention to provide an apparatus for open-end spinning, which overcomes the hereinafore-mentioned disadvantages of the heretofore-known devices of this general type and which provides a yarn draw-off nozzle that brings about an increase in yarn twist in the region between the yarn draw-off nozzle and the rotor groove and that can be used even with vulnerable types of yarn.

With the foregoing and other objects in view there is provided, in accordance with the invention, a yarn draw-off nozzle for an open-end spinning station of a rotor spinning machine, comprising a yarn feed region including a spiral having at least one turn with spirally extending surfaces disposed one above the other being rectilinear with respect to a yarn travel direction, the surfaces each being inclined at an angle relative to the surfaces located above and below them, defining spirally extending yarn deflection locations for supporting yarn to be drawn off.

The advantage of constructing the yarn draw-off nozzle in this way is that on one hand the yarn is adequately supported on the surfaces that are rectilinear with respect to the yarn travel direction, and thus the pressure per unit of surface area acting on the yarn is reduced to a tolerable amount. On the other hand, the yarn deflection points or locations that are formed between the surfaces at angles to one another transmit shear components to the yarn, which cause the yarn twist in the region between the yarn draw-off nozzle and the rotor groove to be kept at an increased value.

Increasing the yarn twist in this region leads to an increase in spinning stability of the open-end rotor spinning apparatus. When the yarn draw-off nozzle according to the invention is used, it is therefore possible, even with fibers that are vulnerable to a high pressure per unit of surface area, such as chemical fibers, either to reduce the number of yarn breaks that occur or to keep the yarn breakage numbers unchanged while increasing the yarn draw-off speed and therefore the productivity of the machine.

In accordance with another feature of the invention, the yarn deflection points or locations disposed between the surfaces are constructed as edges. Tests have shown that contours constructed in this way are excellently suited for transmitting shear components to a traveling yarn.

In accordance with a further feature of the invention, the yarn deflection points or locations disposed between the surfaces have radii. In this way, extremely gentle treatment of the relatively vulnerable yarn is assured.

In accordance with an added feature of the invention, the angle between the surface of one spiral turn relative to the surfaces of the spiral turn extended above or below it are variably large. The largest angles, that is the most-effective yarn deflection points or locations, are then disposed in the upper third of the yarn channel of the yarn draw-off nozzle.

In accordance with an additional feature of the invention, the large-area spiral in the yarn channel of the yarn draw-off nozzle is made with one turn or multiple turns.

In accordance with a concomitant feature of the invention, the yarn deflection locations between the surfaces are edges having additional shoulders disposed on the edges.

Other features which are considered as characteristic for the invention are set forth in the appended claims.

Although the invention is illustrated and described herein as embodied in an apparatus for open-end spinning, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
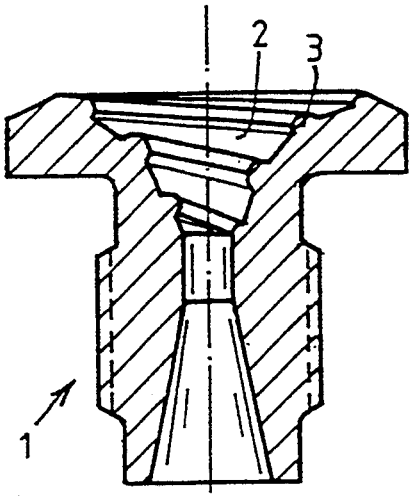
FIG. 1 PRIOR ART
FIG. 1 is a diagrammatic, partly broken-away, longitudinal-sectional view of a yarn draw-off nozzle according to the prior art.

Referring now to the figures of the drawing in detail and first, particularly, to FIG. 1 thereof, there is seen a yarn draw-off nozzle 1 of the kind which is known from the prior art. In a yarn feed region 2 of this yarn draw-off nozzle, spirally extending, protruding yarn deflection points or locations 3 are provided, which can cause damage to vulnerable fibers.

Figure 2:
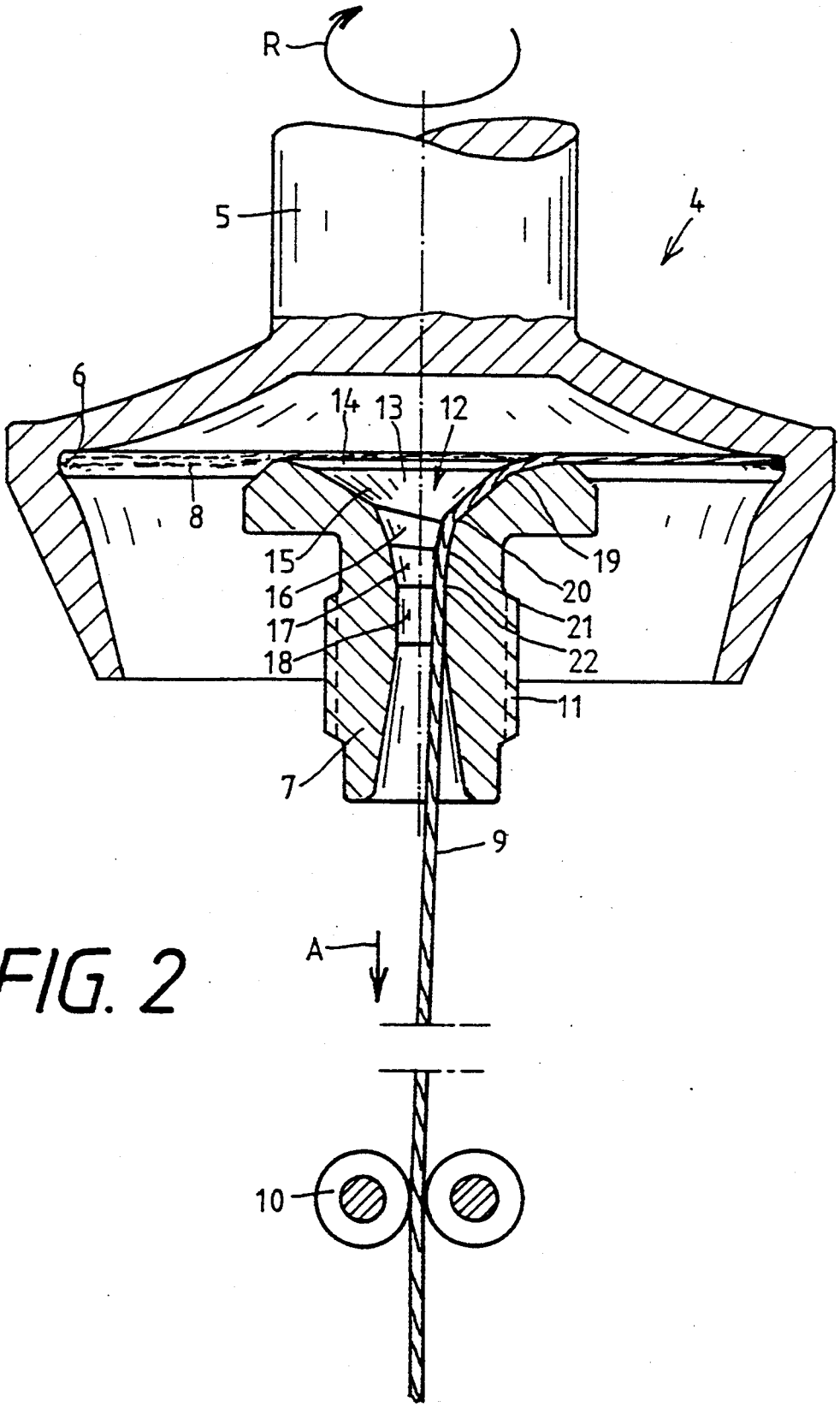
FIG. 2 is a partly broken-away, longitudinal-sectional view of an open-end rotor spinning station with a yarn draw-off nozzle according to the invention.

FIG. 2 shows an open-end rotor spinning station, which is identified overall by reference numeral 4. A yarn draw-off nozzle 7 of the invention is disposed inside a rotor 5 that is open at the front, has a rotor groove 6 and revolves in a rotational direction R in a known manner. Through the use of the yarn draw-off nozzle 7, individual fibers 8 that are collected in the rotor groove 6 are drawn off as yarns 9. A draw-off speed at which the yarn 9 can be drawn off through the draw-off nozzle 7 in a direction A, is dependent on various factors, such as rotor rpm and yarn twist, etc., and can be adjusted at a yarn draw-off shaft 10.

The yarn draw-off nozzle 7 is secured by a male thread 11 in a non-illustrated lid attachment of a spinning station hood.

A yarn draw-off channel 12 in the yarn feed region of the yarn draw-off nozzle 7 is shaped in the form of a large-area spiral 13. As is seen in FIGS. 2 and 5, surfaces 14, 15, 16, 17, etc. of spiral turns extending below or above one another are each inclined at an angle ($\alpha$, $\beta$, $\gamma$, etc.) relative to one another, as viewed in the yarn travel direction A, and between them form yarn deflection points or locations constructed as edges 19, 20, 21, 22, etc.

Figure 5:
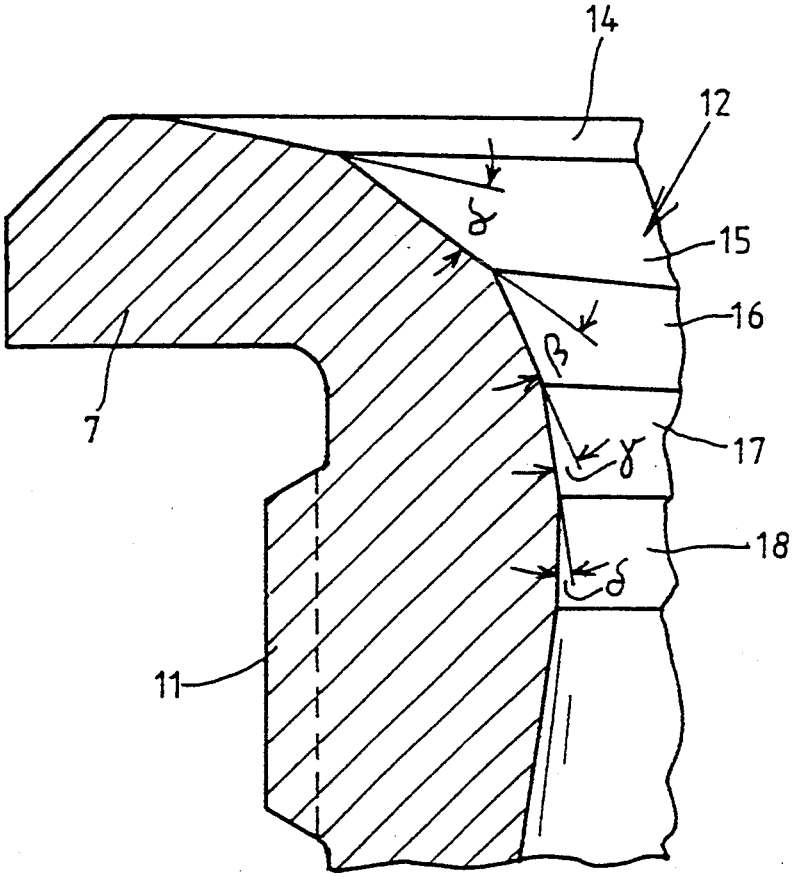
FIG. 5 is an enlarged, fragmentary, longitudinal-sectional view of a yarn draw-off channel of the yarn draw-off nozzle of the invention.

As can be seen particularly from FIG. 5, the angles $\alpha$, $\beta$, $\gamma$, $\delta$ between the surfaces 14, 15, 16, 17, 18 are of various sizes. The largest angles, which are the angles $\alpha$ and $\beta$ in the illustrated exemplary embodiment, are then located in the upper third of the yarn draw-off channel, or in other words the strongest yarn deflection points or locations are shifted far forward into the orifice region of the yarn draw-off channel 12.

Figure 3:
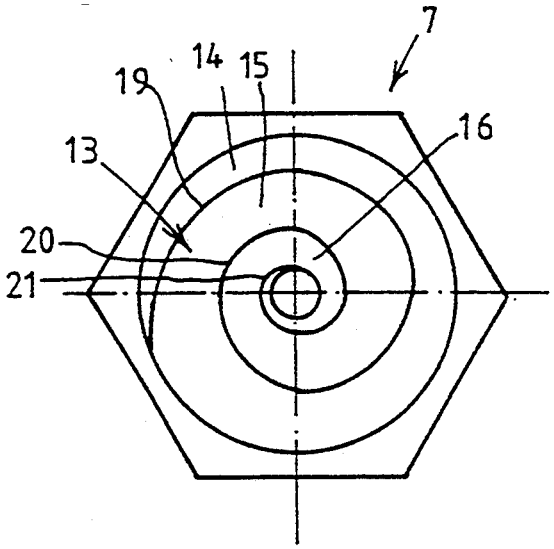
FIG. 3 is a top-plan view of the yarn draw-off nozzle of FIG. 2.
Figure 4:
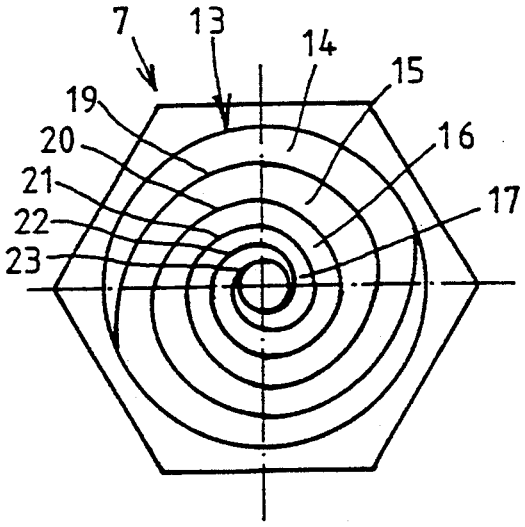
FIG. 4 is a top-plan view of a further embodiment of the yarn draw-off nozzle.

As is suggested in FIGS. 3 and 4, the large-area spiral 13 of the yarn draw-off nozzles 7 may be constructed either with one turn as is seen in FIG. 3 or with a plurality of spiral turns. FIG. 4 shows as an example a yarn draw-off nozzle 7 with a two-turn large area spiral 13 having edges 19–23. The edges may have additional shoulders disposed thereon.

I claim:

1. A yarn draw-off nozzle for an open-end spinning station of a rotor spinning machine, comprising:

a yarn feed region including a spiral having at least one turn with spirally extending surfaces disposed one above the other, said surfaces being rectilinear with respect to a yarn travel direction, said surfaces each being inclined at an angle relative to said surfaces located above and below them, defining spirally extending yarn deflection locations for supporting yarn to be drawn off, said yarn deflection locations between said surfaces being edges and said respective rectilinear surfaces being disposed directly adjacent one another and joined by said edges.

2. The yarn draw-off nozzle according to claim 1, wherein said angles between said surfaces have different sizes.

3. The yarn draw-off nozzle according to claim 1, wherein said spiral is a large area spiral having one turn.

4. The yarn draw-off nozzle according to claim 1, wherein said spiral is a large area spiral having multiple turns.

* * * * *